US009966158B2

(12) United States Patent
Reitz et al.

(10) Patent No.: US 9,966,158 B2
(45) Date of Patent: May 8, 2018

(54) METHOD FOR MANUFACTURING A COLLIMATOR MODULE AND METHOD FOR MANUFACTURING A COLLIMATOR BRIDGE AS WELL AS COLLIMATOR MODULE, COLLIMATOR BRIDGE, COLLIMATOR AND TOMOGRAPHY DEVICE

(71) Applicant: Siemens Aktiengesellschaft, München (DE)

(72) Inventors: Bodo Reitz, Forchheim (DE); Jan Wrege, Erlangen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 281 days.

(21) Appl. No.: 14/850,098

(22) Filed: Sep. 10, 2015

(65) Prior Publication Data

US 2016/0078972 A1 Mar. 17, 2016

(30) Foreign Application Priority Data

Sep. 15, 2014 (DE) ..... 10 2014 218 462

(51) Int. Cl.
*G21K 1/02* (2006.01)

(52) U.S. Cl.
CPC ..... *G21K 1/025* (2013.01)

(58) Field of Classification Search
CPC . G21K 1/02; G21K 1/025; G21K 1/10; A61B 6/4291
See application file for complete search history.

(56) References Cited

U.S. PATENT DOCUMENTS 2,133,385 A * 10/1938 Freeman ..... G21K 1/025 156/252
5,572,034 A * 11/1996 Karellas ..... G01T 1/2018 250/367

(Continued)

FOREIGN PATENT DOCUMENTS

CN 1791944 A 6/2006
CN 102100563 A 6/2011

(Continued)

OTHER PUBLICATIONS

Chinese Office Action and English translation thereof dated Feb. 4, 2017.

(Continued)

*Primary Examiner* — Thomas R Artman
(74) *Attorney, Agent, or Firm* — Harness, Dickey & Pierce, PLC

(57) ABSTRACT

A method for manufacturing a collimator module and/or a collimator bridge is disclosed, as well as a collimator module, a collimator bridge, a collimator and a tomography device. A collimator module for a radiation detector includes a plurality of collimator layers. These collimator layers each have a flat lattice structure. In an embodiment, a first collimator layer has a holder structure and the collimator layers are aligned relative to one another by the holder structure on a first holder tool. With such a holder structure it is possible to glue the aligned collimator layers to one another such that the glued collimator layers form the collimator module with absorber walls disposed in a lattice shape. In such cases, the collimator layers can be aligned to one another in an especially simple and yet precise manner. Through this the actual lattice shape corresponds especially accurately to a prespecified lattice shape.

22 Claims, 5 Drawing Sheets

(56) References Cited

U.S. PATENT DOCUMENTS

| | | | | |
|---|---|---|---|---|
| 5,606,589 | A * | 2/1997 | Pellegrino | A61B 6/502 378/147 |
| 5,949,850 | A * | 9/1999 | Tang | G03F 7/0007 378/145 |
| 6,075,840 | A * | 6/2000 | Pellegrino | A61B 6/502 378/147 |
| 6,363,136 | B1 * | 3/2002 | Flisikowski | G21K 1/025 378/147 |
| 6,594,878 | B2 * | 7/2003 | Kohda | G21K 1/025 156/224 |
| 7,362,849 | B2 * | 4/2008 | Short | G01T 1/1642 378/149 |
| 7,785,098 | B1 * | 8/2010 | Appleby | B29C 33/302 264/319 |
| 8,418,348 | B2 * | 4/2013 | Tonami | G21K 1/025 250/505.1 |
| 9,047,999 | B2 * | 6/2015 | Beck | G21K 1/025 |
| 9,048,002 | B2 * | 6/2015 | Beck | G21K 1/025 |
| 2005/0084072 | A1 * | 4/2005 | Pinchot | G21K 1/02 378/154 |
| 2005/0161608 | A1 | 7/2005 | Heismann | |
| 2006/0124856 | A1 | 6/2006 | Heismann | |
| 2007/0025518 | A1 * | 2/2007 | Levene | G21K 1/025 378/149 |
| 2010/0158195 | A1 | 6/2010 | Wirth | |
| 2011/0019801 | A1 | 1/2011 | Eichenseer et al. | |
| 2011/0099790 | A1 * | 5/2011 | Tonami | G21K 1/025 29/428 |
| 2011/0108745 | A1 | 5/2011 | Pohan | |
| 2012/0085942 | A1 | 4/2012 | Birman et al. | |
| 2012/0087477 | A1 * | 4/2012 | Beck | G21K 1/025 378/154 |
| 2012/0132834 | A1 * | 5/2012 | Freund | G21K 1/025 250/505.1 |
| 2012/0307963 | A1 | 12/2012 | Watanabe et al. | |
| 2013/0272505 | A1 * | 10/2013 | Beck | G21K 1/025 378/154 |
| 2013/0322603 | A1 | 12/2013 | Kurochi et al. | |
| 2015/0179291 | A1 | 6/2015 | Yu | |

FOREIGN PATENT DOCUMENTS

| | | | |
|---|---|---|---|
| CN | 103445802 | A | 12/2013 |
| CN | 103876767 | A | 6/2014 |
| DE | 102004057533 | B4 | 12/2007 |
| DE | 102004001688 | B4 | 1/2010 |
| DE | 102010011581 | A1 | 2/2011 |
| DE | 102010062192 | B3 | 6/2012 |
| DE | 102008061487 | B4 | 1/2013 |
| DE | 102012214865 | A1 | 2/2014 |
| JP | H1170105 | A | 3/1999 |
| JP | 2012152550 | A | 8/2012 |

OTHER PUBLICATIONS

Appleby, Michael et al.: "Tomo-Lithographic-Molding (TLM)—A Breakthrough Manufacturing Process for Large Area Micro-Mechanical Systems"; Mikro Systems, Inc. Charlottesville, VA, Mar. 12, 2005.

Vogtmeier, Gereon et al.: "Two-dimensional Anti-Scatter-Grids for Computed Tomography Detectors", in: Proc. SPIE 6913, Medical Imaging 2008: Physics of Medical Imaging, 691359, Mar. 19, 2008, doi:10.1117/12.770063.

* cited by examiner

METHOD FOR MANUFACTURING A COLLIMATOR MODULE AND METHOD FOR MANUFACTURING A COLLIMATOR BRIDGE AS WELL AS COLLIMATOR MODULE, COLLIMATOR BRIDGE, COLLIMATOR AND TOMOGRAPHY DEVICE

PRIORITY STATEMENT

The present application hereby claims priority under 35 U.S.C. § 119 to German patent application number DE 102014218462.2 filed Sep. 15, 2014, the entire contents of which are hereby incorporated herein by reference.

FIELD

At least one embodiment of the present invention generally relates to a method for manufacturing a collimator module, a method for manufacturing a collimator bridge, a collimator module, a collimator bridge, a collimator and/or a tomography device.

BACKGROUND

Tomography is an imaging method in which x-ray projections are recorded from different projection angles. In this method a recording unit, comprising an x-ray source and an x-ray detector, rotates around an axis of rotation and also around an object to be examined. The x-ray detector is generally constructed from a plurality of detector modules which are disposed linearly or in a two-dimensional lattice. Each detector module of the x-ray detector comprises a plurality of detector elements, wherein each detector element can detect x-ray radiation. The detector elements correspond to individual picture elements of an x-ray projection recorded with the x-ray detector. The x-ray radiation detected by a detector element corresponds to an intensity value. The intensity values form the starting point for reconstruction of a tomographic image.

The x-ray radiation emanating from the x-ray source is scattered during the recording of an x-ray projection by the irradiated object, so that as well as the primary rays of the x-ray source, scattered rays also strike the x-ray detector. The scattered rays cause noise in the x-ray projection or in the reconstructed image and therefore reduce the detectability of differences in contrast in the x-ray image. To reduce scattered radiation influences an x-ray detector can have a collimator which causes only x-ray radiation of a specific spatial direction to fall on the detector elements. Such a collimator typically has a number of collimator bridges with a number of collimator modules. The individual collimator modules have absorber walls for absorption of scattered radiation and are aligned to the focus of the x-ray source.

Collimators are known for example from the publication DE 10 2010 062 192 B3. The publication describes self-supporting collimator bridges which are manufactured by gluing together collimator modules. These collimator bridges have a high level of rigidity and thus allow reliable collimation. However the manufacturing of such collimator bridges is only described on the basis of already produced collimator modules. It is further disclosed that an especially high inherent rigidity is able to be achieved with collimator modules manufactured in one piece.

In modern computed tomography large x-ray detectors curved along two spatial directions are used. In other words the detector modules have submodules which are disposed tilted in relation to one another such that a detector module curved along the axis of rotation is embodied. Previously self-supporting collimators have not been used for such x-ray detectors but the collimator modules are directly attached to the submodules. This is because the collimators for such x-ray detectors have increased rigidity and production accuracy requirements. In order to guarantee these requirements it is also necessary to optimize the manufacturing process for collimator modules.

SUMMARY

An embodiment of the invention specifies the manufacturing of collimator modules with high accuracy. Furthermore these collimator modules are to be processed especially accurately and with few working steps into a curved collimator bridge which is as strong as possible.

Embodiments of the invention are directed to a method, a collimator module, a collimator bridge, a collimator and a tomography device.

Embodiments of the present invention will be described below as a method and also in terms of a physical device. Features, advantages or alternate forms of embodiment mentioned here are likewise to be transferred to the other claimed objects and vice versa. In other words the physical claims which are directed to a device for example can also be further developed with the features which are described or claimed in conjunction with a method. The corresponding functional features of the method are embodied in such cases by corresponding physical modules.

An inventive collimator module for a radiation detector of an embodiment has a plurality of collimator layers. These collimator layers each have a flat lattice structure.

An embodiment of the invention further relates to a collimator bridge, wherein a first collimator module and a second collimator module are manufactured in accordance with an embodiment of the invention, wherein the first collimator module and the second collimator module are glued to one another, wherein, absorber walls standing at the edges of the first collimator module and the second collimator modules are glued to one another. This enables a freestanding collimator bridge to be produced in an especially strong and precise manner.

In accordance with a further embodiment of the invention, the collimator bridge is embodied for collimation of radiation for a radiation detector able to be rotated around an axis of rotation, wherein the collimator modules are arranged in relation to one another so that the collimator bridge has a curvature along the axis of rotation. The collimator bridge is then the especially well-suited for large-area, curved radiation detectors, especially for radiation detectors curved along two spatial directions.

BRIEF DESCRIPTION OF THE DRAWINGS

The invention is described and explained below in greater detail on the basis of example embodiments shown in the figures, in which.

DETAILED DESCRIPTION OF THE EXAMPLE EMBODIMENTS

Figure 1:
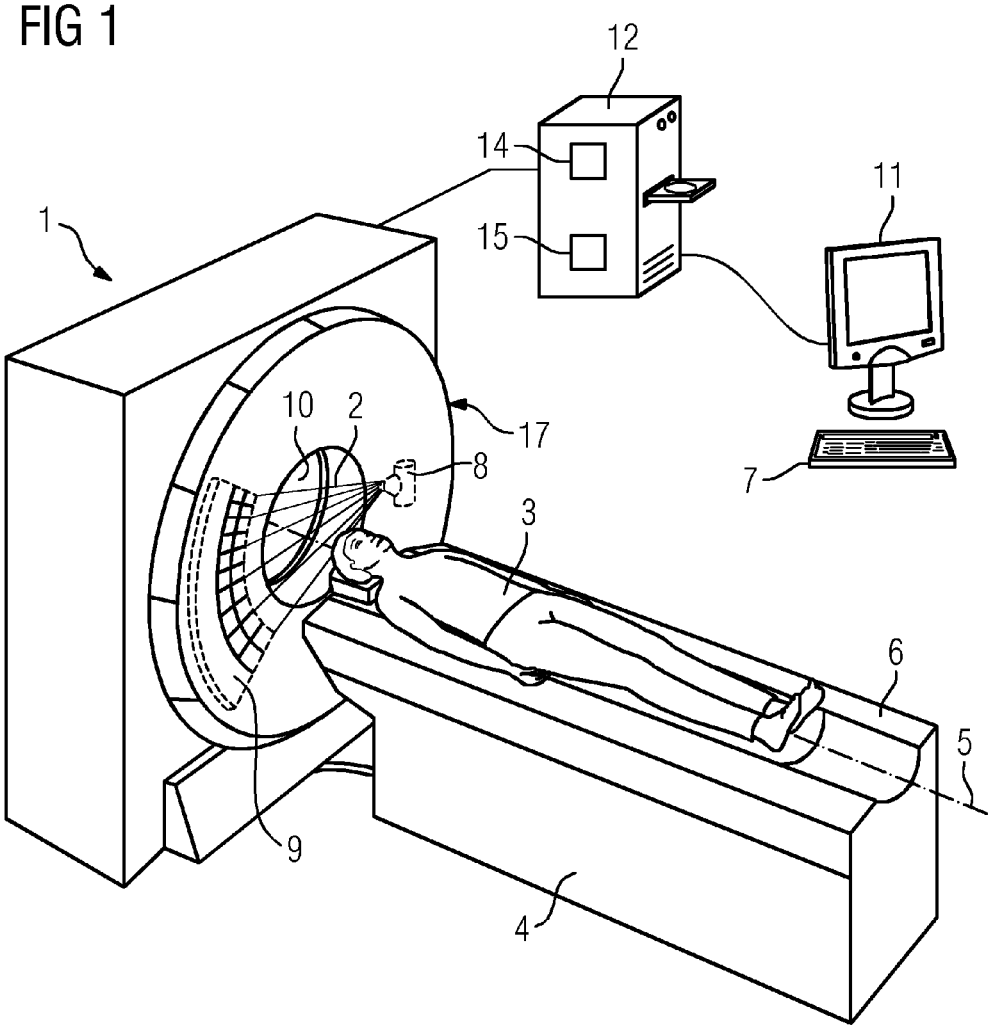
FIG. 1 shows a tomography device using a computed tomograph as an example.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

An inventive collimator module for a radiation detector of an embodiment has a plurality of collimator layers. These collimator layers each have a flat lattice structure.

The inventors have recognized that the collimator module is produced with especially high accuracy if a first collimator layer has a holding structure and the collimator layers are aligned by the holding structure on a first holder tool relative to one another. This is because it is possible, with such a holding structure, to glue the aligned collimator layers to each other such that the glued collimator layers embody the collimator module with absorber walls disposed in a lattice shape. In such cases the collimator layers can be aligned in an especially simple and yet still precise manner. This means that the actual lattice form of the absorber walls corresponds especially precisely to a prespecified lattice form.

In accordance with a further embodiment of the invention, the collimator layers are aligned and glued such that the surfaces of the absorber walls are embodied even. This means that the absorption of radiation by the absorber walls only occurs in the area provided for it of a prespecified lattice structure. In this sense the collimator is produced with especially high accuracy.

In accordance with a further embodiment of the invention the holder structure extends beyond the lattice structure. This enables the lattice structure in accordance with this aspect to be especially easily separated from a completed collimator module.

In accordance with a further embodiment of the invention the holder structure is separated after the gluing together of the collimator modules. This means that the holder structure can no longer influence the radiation absorption by the collimator, in particular an undesired radiation absorption by the holder structure is avoided.

An embodiment of the invention further relates to a collimator bridge, wherein a first collimator module and a second collimator module are manufactured in accordance with an embodiment of the invention, wherein the first collimator module and the second collimator module are glued to one another, wherein, absorber walls standing at the edges of the first collimator module and the second collimator modules are glued to one another. This enables a freestanding collimator bridge to be produced in an especially strong and precise manner.

In accordance with a further embodiment of the invention a second collimator layer of the first collimator module has a positioning element standing at its edge, wherein the first collimator module can be positioned relative to the second collimator module by the positioning element. This enables a very exact positioning of the collimator modules in relation to one another to be realized in a very simple manner.

In accordance with a further embodiment of the invention, the first collimator module and the second collimator module are aligned on the first holder tool or on a second holder tool by at least one part of the holder structure in relation to one another, wherein peripheral absorber walls of the aligned first collimator module and the aligned second collimator module standing on the edge are glued to one another so that they are as congruent as possible. In other words the peripheral absorber walls are glued to one another so that these absorber walls are aligned in parallel with one another. This means that the surface provided for the adhesive contact is as large as possible and the collimator bridge is embodied especially strong.

In accordance with a further embodiment of the invention a collimator bridge is manufactured by a first collimator module and a second collimator module being manufactured in accordance with an embodiment of the invention, wherein alternately collimator layers assigned to the first collimator module and also the second collimator module are glued to one another such that the peripheral areas of the collimator layers assigned to the first collimator module and also of the second collimator module are glued to one another. This enables a collimator bridge to be manufactured with especially few working steps, since no separate production of the individual collimator modules is required. This means that the collimator bridge is produced especially quickly.

In accordance with a further embodiment of the invention at least a second collimator layer of the first collimator module has a peripheral positioning element, wherein the second collimator layer is positioned relative to a third collimator layer of the second collimator module by the positioning element. Through this the individual collimator layers are aligned in an especially precise and simple manner.

In accordance with a further embodiment of the invention the collimator layers assigned to the first collimator module and the second collimator module are aligned in relation to one another on the first holder tool or on a second holder tool by at least one part of the holder structure, wherein peripheral areas of the aligned collimator layers are glued to one another so that they are as congruent as possible. Through this the collimator module is embodied especially strong.

In accordance with a further embodiment of the invention the collimator bridge is embodied for collimation of radiation for a radiation detector able to be rotated around an axis of rotation, wherein the collimator modules are arranged in relation to one another so that the collimator bridge has a curvature along the axis of rotation. The collimator bridge is then the especially well-suited for large-area, curved radiation detectors, especially for radiation detectors curved along two spatial directions.

Furthermore a collimator for a radiation detector able to be rotated around an axis of rotation can comprise a number of collimator bridges manufactured in accordance with the invention, which are connected to one another along the axis of rotation. The collimator bridges can also be connected to one another such that the collimator has a curvature along the direction of rotation.

FIG. 1 shows a tomography device using a computed tomograph as an example. The computed tomograph shown here has a recording unit 17, comprising a radiation source 8 in the form of an x-ray source and also a radiation detector 9 in the form of an x-ray detector. The recording unit 17 rotates during a recording of x-ray projections around an axis of rotation 5 and the x-ray source emits rays 2 in the form of x-rays during the recording. In the example shown here the x-ray source involves an x-ray tube. In the example shown here the x-ray detector involves a row-detector with a number of rows.

In the example shown here a patient 3 lies on a patient couch 6 during the recording of x-ray projections. The patient couch is connected to a couch base 4 such that the base carries the patient couch 6 with the patient 3. The patient couch 6 is designed to move the patient 3 along a recording direction through the opening 10 of the recording unit 17. The recording direction is generally given by the axis of rotation 5 around which the recording unit 17 rotates during the recording of x-ray projections. During a spiral recording the patient couch 6 is continuously moved through the opening 10 while the recording unit 17 is rotating around the patient 3 and is recording x-ray projections. Thus the x-rays describe a spiral on the surface of the patient 3.

For reconstruction of an x-ray image the computed tomograph shown here has a reconstruction unit 14 designed to reconstruct a tomographic image. The reconstruction unit 14 can be realized both in the form of hardware and also as software. The computer 12 is connected to an output unit 11 and also to an input unit 7. Furthermore different views of the recorded x-ray projections—i.e. reconstructed images, rendered surfaces or slice images—can be displayed on the display unit 11 in the form of a screen. The input unit 7 involves a keyboard, a mouse, a touchscreen or also a microphone for voice input for example.

Figure 2:
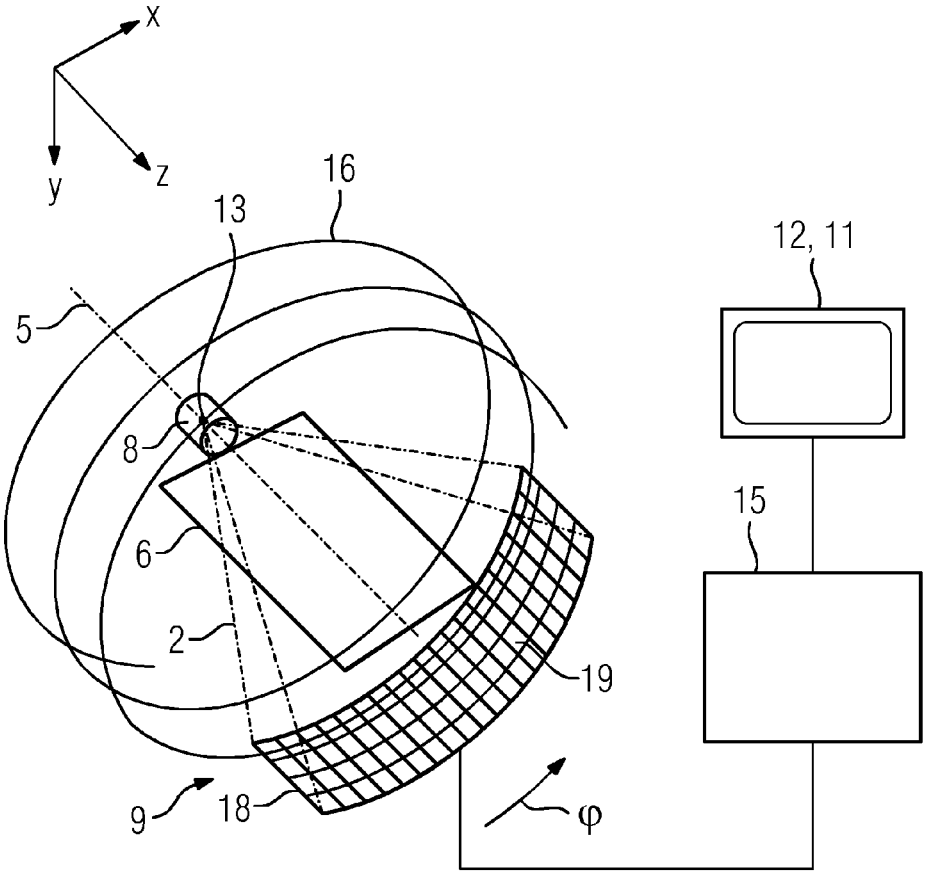
FIG. 2 shows a tomography device in a part perspective, part block diagram-type diagram.

FIG. 2 shows a part perspective, part block diagram-type diagram of an inventive tomography device. In a computed tomograph, the radiation detector 9 is generally curved along the spatial direction indicated with φ in relation to the z-axis. The submodules 14 of the radiation detector 9 can however also be disposed so that the radiation detector 9 is curved in relation to the x-axis and the detector modules 18 are aligned along two dimensions to the focus 13 of the radiation source 8. The radiation detector 9 has a plurality of detector modules 18 with a number of detector elements 19. In the example shown here the detector modules 18 are delimited from one another by solid lines along the axis of rotation, wherein each detector modules 18 has four submodules 14. The detector elements 19 are not shown in any greater detail here. Furthermore the radiation detector 9 has a collimator not shown in any greater detail here. The collimator can include a number of collimator modules 30. The individual collimator modules 30 as well as the absorber walls of the collimator can be aligned to the focus 13 of the radiation source 8.

Figure 3:
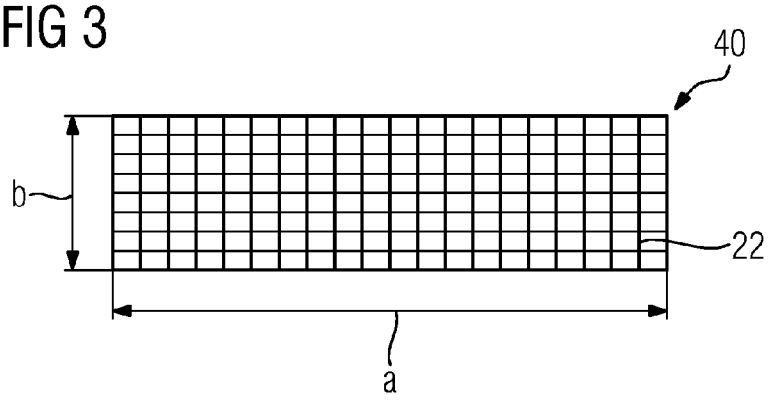
FIG. 3 shows a collimator layer for a collimator module in an overhead view.

FIG. 3 shows a collimator layer of a collimator module in an overhead view. The collimator layer 40 has a width b and a length a and is embodied flat, since it has a flat lattice structure. The lattice structure is embodied by absorber elements 22 disposed in the shape of the lattice. The absorber elements 22 can, as in the examples shown here, embody a regular lattice structure, so that neighboring absorber elements 22, at least in one spatial direction, are at the same distances from one another. The absorber elements 22 can however also embody an irregular lattice structure, in which the distances of neighboring absorber elements 22 in one spatial direction vary. Furthermore the absorber elements 22 can run in parallel and also not in parallel to one another. The layer height h of an absorber element 22, i.e. in FIG. 3 the extent into the plane of the drawing, typically amounts to between 0.5 mm and 10 mm, especially between 1 mm and 5 mm. the order of magnitude of the width b and the length a typically lies in the range of a few centimeters.

The absorber elements 22 must be able to absorb radiation 2, especially x-ray radiation. Therefore the collimator layers 40, 41, 42, 43, 44 can have metallic components and especially be produced by a vacuum casting of metal compounds. The collimator layers 40, 41, 42, 43, 44 can also be produced by printing metal powder with a 3-D printer or by melting metal powder with lasers.

Figure 4:
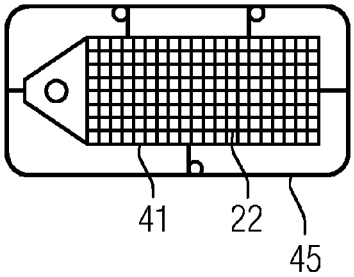
FIG. 4 shows a first collimator layer in an overhead view.

FIG. 4 shows a first collimator layer in an overhead view. The first collimator layers 41 are each characterized in that they have a holder structure 45. The holder structure 45 can be produced together with the collimator layer 41 as a one-piece component, especially by vacuum casting. In the example shown in FIG. 4 the holder structure 45 lies in the plane of the associated collimator layer 41. The holder structure 45 comprises a holder frame 45 surrounding the first collimator layer 41, wherein the holder frame has a rectangular shape with rounded corners here. The holder frame 45 can also have other shapes surrounding the first collimator layer 41. This holder frame is connected by a number of webs to the first collimator layer 41. Furthermore the holder structure 45 has ring-shaped structures which are suitable for a pin or a screw to pass through. In particular it is possible for the ring-shaped structures to have a pin passing through them in each case, wherein the pins are fastened to a first holder tool so that the first collimator layer 41 is aligned relative to the holder tool. Further collimator layers 40, 41, 42, 43, 44 of a collimator module 30, 31, 32, 33 can now be aligned by such a pin on the first holder tool. In such cases the collimator layers 40, 41, 42, 43, 44 are aligned to one another such that the collimator layers 40, 41, 42, 43, 44 form a collimator module 30, 31, 32, 33 with absorber walls disposed in the shape of a lattice.

The modules are aligned for example in that a collimator module 30, 31, 32, 33 only has first collimator layers 41 with a holder structure 45. If the holder structures 45 of the first collimator layer 41 of a collimator module 30, 31, 32, 33 have the same shape and size, the holder structures 45 can be laid one above the other with a precise fit. In particular a pin or a screw can pass through the ring-shaped structures laid above one another of different first collimator layers 41 and thus align the layers in relation to one another. If the pin or the screw is aligned on the first holder tool, then the first collimator layers 41 are likewise aligned on the holder tool.

If the holder structures 45 project beyond the lattice structure, then it is especially simple to align the collimator layers 40, 41, 42, 43, 44 of a collimator module 30, 31, 32, 33. In a further form of embodiment the holder structures 45 can however also lie within the lattice structure or be embodied as a part of the lattice structure. For example the holder structure 45 can be embodied in the form of a ring-shaped structure within the lattice structure. Furthermore the holder structure 45, after the connection of the individual collimator layers 40, 41, 42, 43, 44 to a collimator module 30, 31, 32, 33, can at least be partly separated.

Figure 5:
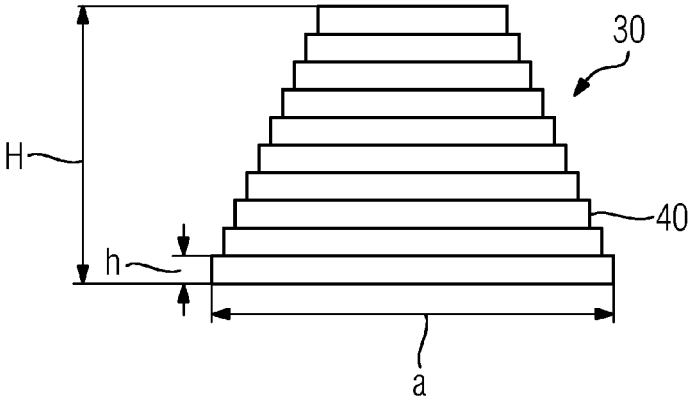
FIG. 5 shows a collimator module in a side view.

FIG. 5 shows a schematic side view of a collimator module. In this figure a number of collimator layers 40 form a collimator module 30. The individual collimator layers 40 are connected to one another by gluing or by other joining techniques for example, so that the absorber elements 22 form absorber walls. As shown here, ten collimator layers 40, each with a layer height h of 2 mm, can form the collimator module 30 with a module height H of 2 cm. Thus the width b and the length a of the various collimator layers 40 of a collimator module 30 can vary, so that the collimator module 30 is embodied, in the side view shown in FIG. 5, in a trapezoidal shape.

In further forms of embodiment the outer contour of a collimator module 30, 31, 32, 33 is not embodied in a step shape but with continuous transitions or as a smooth contour. Also the surfaces of the absorber walls can be embodied smooth. Furthermore the absorber elements 22 of the various collimator layers 40, 41, 42, 43, 44 can each be inclined so that a corresponding collimator module 30, 31, 32, 33 has absorber walls running towards each other. In particular, when a collimator module 30, 31, 32, 33 is used in a tomography device, the absorber walls can be aligned to the focus 13 of a radiation source 8.

Figure 6:
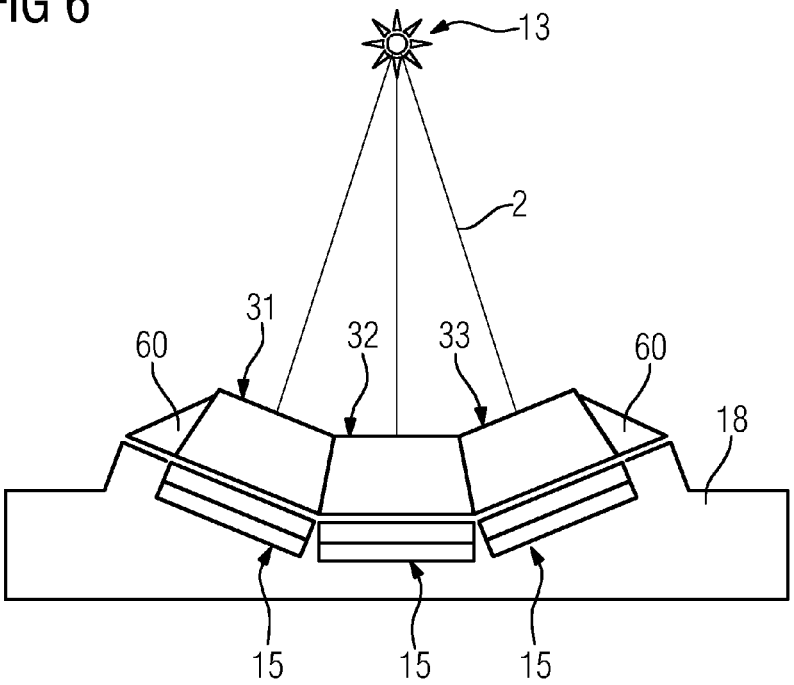
FIG. 6 shows a collimator bridge with a detector module in a side view.

FIG. 6 shows an inventive collimator bridge of an embodiment, with a detector module in a side view. The collimator bridge comprises a first collimator module 31, a second collimator module 32 and also a third collimator module 33. In the example shown here the absorber walls are aligned to the focus 13 of a radiation source 8, in that the collimator bridge exhibits a curvature along the axis of rotation 5. The curvature is created by the first collimator module 31 and the second collimator module 32 as well as the second collimator module 32 and the third collimator module 33 each being connected to one another at a defined angle. This allows a collimator with outstanding collimation properties to be produced even for large-area, curved radiation detectors 9.

The radiation detector 9, in the example shown here, comprises a number of submodules 15, wherein each submodule 15 is assigned to a collimator module. The submodules 15 form a detector module 18, wherein a number of detector modules 18 are disposed along the direction indicated by φ in FIG. 2, in order to form a radiation detector 9. Furthermore the collimator bridge, in the example shown here, has two holder elements 60, which each fasten one of the peripheral collimator modules 30, 31, 32, 33 and thus the entire collimator bridge to the detector module 18. In particular the holder structures 60 can serve to align the collimator bridge in relation to the detector module 18 or the entire collimator in relation to the radiation detector 9. The holder structures 60 are connected for example by a screw connection, a plug-in connection, gluing or another joining technique on one side to a peripheral collimator module 30, 31, 32, 33 and also to the detector module 18. Furthermore the individual collimator modules 30, 31, 32, 33 can be not connected directly to the individual submodules 15, so that the collimator bridge is embodied self-supporting.

Figure 7:
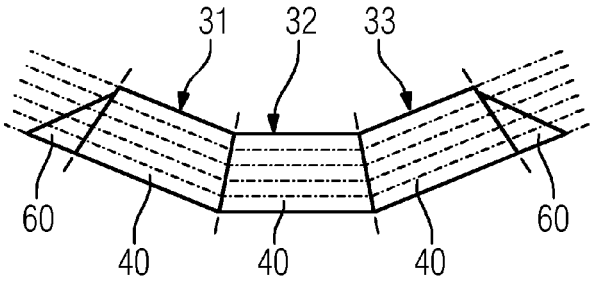
FIG. 7 shows a collimator bridge in a side view.

FIG. 7 shows a collimator bridge in a side view. In this figure the individual collimator layers 40 of the first, second and third collimator modules 31, 32, 33 are disposed in parallel to one another in each case. The dashed lines in each case specify the dividing lines between the different collimator layers 40 between the first, second and third collimator modules 31, 32, 33. This example illustrates why no one-piece, angled collimator layers are produced for a collimator bridge, but why different collimator modules 30, 31, 32, 33 each with separate collimator layers 40 are combined into a collimator bridge. This is because with usual manufacturing methods for metallic lattice structures, especially with vacuum casting, it is not possible or only possible with difficulty to manufacture an angled lattice structure. During casting of metal melts, a flat surface is formed because of the gravitational force; but an angled lattice structure does not just lie in one plane and has no flat surface.

Figure 8:
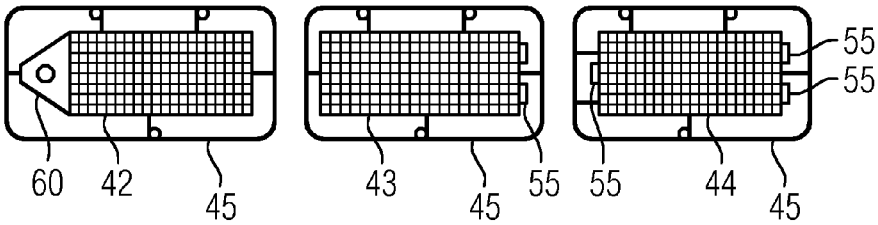
FIG. 8 shows a number of collimator layers in an overhead view.

FIG. 8 shows a number of collimator layers in an overhead view. A second collimator layer 42 is characterized in that it has at least one positioning element 55; however in further form of embodiment the other collimator layers 40, 41, 43 can also have a positioning element 55. The positioning elements 55 of a specific collimator layer 40, 41, 42, 43 can be produced, together with these collimator layers 40, 41, 42, 43 as a one-piece component, especially by vacuum casting. The first collimator module 31 can have a second collimator layer 42 with a peripheral positioning element 55 so that the first collimator module 31 can be positioned relative to a second collimator module 32.

The positioning element 55 can be embodied both as a protrusion and also as a recess. If a second collimator module 32 also has a third collimator layer 43 with a positioning element, the positioning elements 55 of the first collimator module 31 and also of the second collimator module 32 can be embodied complementarily to each other. The positioning through the positioning element 55 can basically be done in each of the three spatial directions. The positioning elements 55 can lie in the plane of the associated collimator layer 40, 41, 42, 43; but they can also protrude from this plane or be embodied by recesses at right angles to this plane.

Furthermore, positioning elements 55, especially attached to the underside or upper side of a collimator module 30, 31, 32, 33, can be designed to align the collimator module 30, 31, 32, 33 on the first holder tool or on a second holder tool. This especially enables a first collimator module 31 with a positioning element 55 and a second collimator module 32 with a positioning element 55 to be positioned relative to one another by an alignment on a holder tool. For example the first or second holder tool can comprise a plate-type structure with protrusions or recesses, so that positioning elements 55 attached to the underside or upper side of the collimator module 30, 31, 32, 33 fit complementarily in protrusions or recesses of the plate-type structure.

Figure 9:
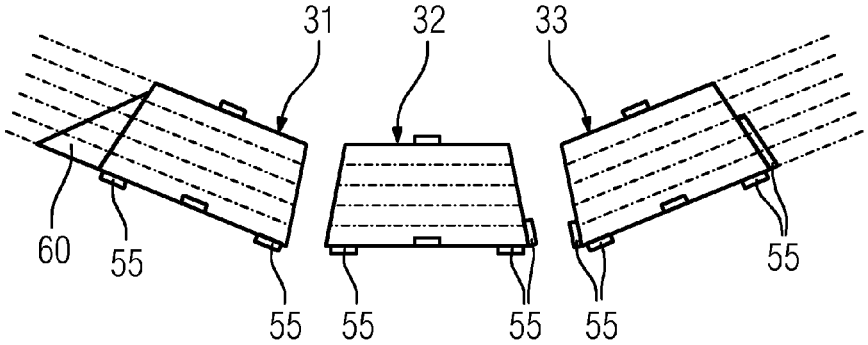
FIG. 9 shows a number of collimator layers on a side view.

FIG. 9 shows a number of collimator modules in a side view. In accordance with a first form of embodiment of the invention first of all individual collimator modules 30, 31, 32, 33 are manufactured which are then connected to one another. In particular in this case the peripheral absorber walls of a first collimator module 31 and of a second collimator module 32 can be glued to one another. Preferably the peripheral absorber walls are glued to one another as congruently as possible, so that the surface for the glued connection is as large as possible. In such cases the collimator modules 30, 31, 32, 33 glued to one another can basically be embodied in the same way, i.e. have especially the same size of peripheral absorber walls. The collimator modules 31, 32, 33 shown here each have a number of positioning elements 55, so that in each case neighboring collimator modules 31, 32, 33 can be positioned relative to one another. Furthermore the collimator modules 31, 32, 33 can be aligned relative to one another by means of the first holder tool or by means of a second holder tool. This enables the collimator bridge to be produced especially accurately.

Figure 10:
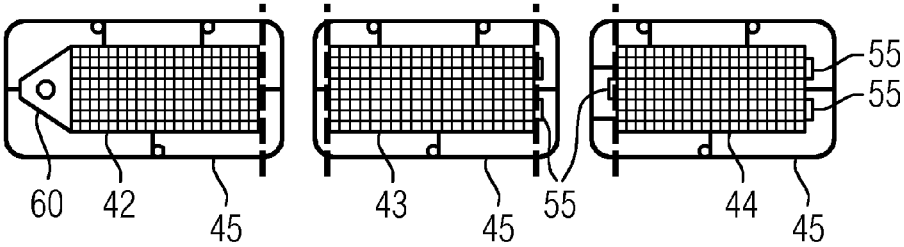
FIG. 10 shows a number of collimator layers in an overhead view.

FIG. 10 shows a number of collimator layers in an overhead view. Unlike in FIG. 8, separation lines are shown as dashed lines here, along which at least one part of the holder structure 45 can be separated. The separation lines can be realized by intended-break points or perforations and can run other than shown here. The separation generally occurs only after the first collimator layers provided with a holder structure 45 have been constructed in each case as part of a collimator module 30, 31, 32, 33. Separating the respective holder structures 45 along the separation line shown in FIG. 10 is primarily of advantage if the remaining parts of the holder structure 45 are to be used again, in order to align the already manufactured collimator modules 30, 31, 32, 33 relative to one another. This can be done in the example shown here by the holder structures 45 being partly separated as shown in FIG. 10 after manufacturing of the first collimator module 31, the second collimator module 32, and the third collimator module 33 and then these collimator modules 31, 32, 33 being aligned by means of the remaining holder structure 45 to a second holder tool.

Figure 11:
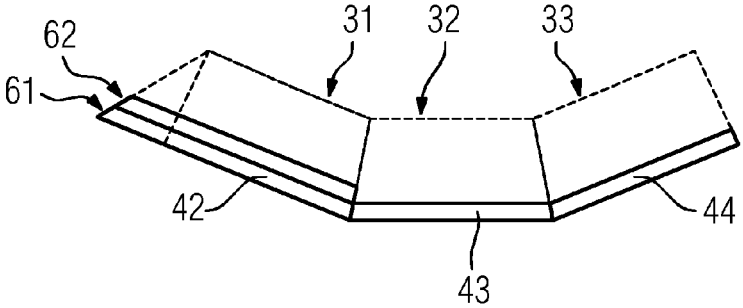
FIG. 11 shows the manufacturing of a collimator bridge in accordance with a second form of embodiment of the invention.

In a second form of embodiment of the invention at least one first collimator module 31 and at least one second collimator module 32 are manufactured, wherein alternately collimator layers 40, 41, 42, 43, 44 assigned to the first collimator module 31 and to the second collimator module 32 are glued such that peripheral areas of the collimator layers 40, 41, 42, 43, 44 assigned to the first collimator module 31 and to the second collimator module 32 are glued to each other. The collimator bridge is thus constructed in layers. This second form of embodiment is illustrated in FIG. 11. The still incomplete first, second and third collimator modules 31, 32, 33 are identified in each case in FIG. 11 by corresponding dashed lines. In this example, from left to right, three collimator layers 42, 43, 44 of a first layer 61 are built up, which are assigned to different collimator modules 31, 32, 33. Then accordingly the second layer 62 of the collimator bridge is manufactured, etc.

With this second form of embodiment, a second collimator layer 42 of a first collimator module 31 can have a peripheral positioning element 55, so that the second collimator layer 42 is positioned relative to a third collimator layer 43 of a second collimator module 32 by the positioning element 55. Likewise in the second form of embodiment the collimator layers 40, 41, 42, 43, 44 assigned to the first collimator module 31 and the second collimator module 32 can be aligned in relation to each other on the first holder tool or on a second holder tool by at least one part of the holder structure 45, wherein peripheral areas of the aligned collimator layers 40, 41, 42, 43, 44 are glued to each other as congruently as possible.

The properties of a collimator layer 40 described for explaining the figures can also extend to the first collimator layer 41, the second collimator layer 42 as well as the third collimator layer 43 and the fourth collimator layer 44. In exactly the same way the properties of a collimator layer 30 described for explaining the figures can also extend to the first collimator layer 31, the second collimator layer 32 and also the third collimator layer 33.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Even further, any of the aforementioned methods may be embodied in the form of a program. The program may be stored on a tangible computer readable medium and is adapted to perform any one of the aforementioned methods when run on a computer device (a device including a processor). Thus, the tangible storage medium or tangible computer readable medium, is adapted to store information and is adapted to interact with a data processing facility or computer device to execute the program of any of the above mentioned embodiments and/or to perform the method of any of the above mentioned embodiments.

The tangible computer readable medium or tangible storage medium may be a built-in medium installed inside a computer device main body or a removable tangible medium arranged so that it can be separated from the computer device main body. Examples of the built-in tangible medium include, but are not limited to, rewriteable non-volatile memories, such as ROMs and flash memories, and hard disks. Examples of the removable tangible medium include, but are not limited to, optical storage media such as CD-ROMs and DVDs; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method for manufacturing a collimator module for a radiation detector, the collimator module including collimator layers, each collimator layer including a flat lattice structure, the method comprising:

preparing the collimator layers to include a first collimator layer with a holder structure;

aligning the collimator layers by the holder structure on a first holder tool; and gluing the aligned collimator layers to one another such that edges of each of the glued collimator layers together form an angled external absorber surface of the collimator module disposed in a lattice shape, an angle of the absorber surface being relative to a planar surface of the collimator layers and based on a size of each of the glued collimator layer.

2. The method of claim 1, wherein the collimator layers are aligned and glued such that surfaces of the absorber walls are embodied flat.

3. The method of claim 2, wherein the holder structure extends beyond the lattice structure.

4. The method of claim 2, wherein the holder structure, after the gluing of the collimator module, is at least partly separated.

5. The method of claim 1, wherein the holder structure extends beyond the lattice structure.

6. The method of claim 1, wherein the holder structure, after the gluing of the collimator module, is at least partly separated.

7. A method for manufacturing a collimator bridge including at least one first collimator module manufactured in accordance with the method of claim 1 and at least one second collimator module manufactured in accordance with the method of claim 1, the method comprising:

gluing the at least one first collimator module and the at least one second collimator module to one another, wherein peripheral absorber walls of the at least one first collimator module and of the at least one second collimator module are glued to one another.

8. The method of claim 7, wherein a second collimator layer of the at least one first collimator module includes a peripheral positioning element, and wherein the at least one first collimator module is positioned relative to the at least one second collimator module by the positioning element.

9. The method of claim 7, further comprising:

aligning the at least one first collimator module and the at least one second collimator module in relation to one another on the first holder tool or on a second holder tool by at least one part of the holder structure, wherein peripheral absorber walls of the aligned at least one first collimator module and of the aligned at least one second collimator module are substantially congruently glued to one another.

10. The method of claim 9, wherein the collimator bridge is embodied for collimation of rays for a radiation detector rotatable around an axis of rotation of the radiation detector, wherein the first at least one collimator module and the second at least one collimator module are disposed in relation to one another so that the collimator bridge has a curvature along a direction of rotation of the radiation detector.

11. A collimator bridge, manufactured according to the method of claim 7.

12. A collimator for a radiation detector, rotatable around an axis of rotation, wherein a number of collimator bridges manufactured according to the method of claim 7 are connected to one another along a direction of rotation of the radiation detector.

13. A collimator as claimed in claim 12, wherein the collimator bridges are connected to one another such that the collimator has a curvature along the direction of rotation.

14. A tomography device with the collimator for collimating x-rays of claim 12.

15. A method for manufacturing a collimator bridge including at least one first collimator module manufactured in accordance with the method of claim 1 and at least one second collimator module manufactured in accordance with the method of claim 1, the method comprising:

gluing collimator layers, assigned to the at least one first collimator module and to the at least one second collimator module, alternately such that peripheral areas of the collimator layers assigned to the at least one first collimator module and to the at least one second collimator module are glued to one another.

16. The method of claim 15, wherein a second collimator layer of the at least one first collimator module includes a peripheral positioning element, the method further comprising:

positioning, via the positioning element, the second collimator layer relative to a third collimator layer of the at least one second collimator module.

17. The method of claim 16, further comprising:

aligning the collimator layers, assigned to the at least one first collimator module and the at least one second collimator module, to one another at the first holder tool or at a second holder tool via at least a part of the holder structure, wherein peripheral areas of the aligned collimator layers are glued to each other as congruently as possible.

18. The method of claim 15, further comprising:

aligning the collimator layers, assigned to the at least one first collimator module and the at least one second collimator module, to one another at the first holder tool or at a second holder tool via at least a part of the holder structure, wherein peripheral areas of the aligned collimator layers are glued to each other as congruently as possible.

19. A collimator bridge, manufactured according to the method of claim 15.

20. A collimator for a radiation detector, rotatable around an axis of rotation, wherein a number of collimator bridges manufactured according to the method of claim 15 are connected to one another along a direction of rotation of the radiation detector.

21. A tomography device with the collimator for collimating x-rays of claim 20.

22. A collimator module, manufactured according to the method of claim 1.

* * * * *